US007692085B2

(12) United States Patent
Adams

(10) Patent No.: US 7,692,085 B2
(45) Date of Patent: Apr. 6, 2010

(54) DEVICE FOR ADJUSTING THE TENSION OF THE STRINGS OF A STRINGED INSTRUMENT

(75) Inventor: Christopher Adams, Hamburg (DE)

(73) Assignee: Tectus Anstalt, Vaduz (LI)

( * ) Notice: Subject to any disclaimer, the term of this patent is extended or adjusted under 35 U.S.C. 154(b) by 0 days.

(21) Appl. No.: 11/908,577

(22) PCT Filed: Mar. 17, 2005

(86) PCT No.: PCT/EP2005/002851

§ 371 (c)(1),
(2), (4) Date: Mar. 14, 2008

(87) PCT Pub. No.: WO2006/097125

PCT Pub. Date: Sep. 21, 2006

(65) Prior Publication Data

US 2009/0038462 A1 Feb. 12, 2009

(51) Int. Cl.
*G10G 7/02* (2006.01)

(52) U.S. Cl. ..... 84/454; 84/304; 84/312 R

(58) Field of Classification Search ..... 84/304, 84/454, 312 R

See application file for complete search history.

(56) References Cited

U.S. PATENT DOCUMENTS 2,021,706 A * 11/1935 Wickliffe ..... 180/443
2,917,963 A * 12/1959 Lucchesi ..... 84/282
3,130,626 A 4/1964 Martin
3,428,274 A * 2/1969 Ellis et al. ..... 244/103 R
3,813,983 A 6/1974 Paul
4,018,124 A 4/1977 Rosado
4,088,052 A * 5/1978 Hedrick ..... 84/454
4,128,033 A 12/1978 Petillo
4,197,779 A 4/1980 Holman
4,318,327 A 3/1982 Toups
4,375,180 A * 3/1983 Scholz ..... 84/454
4,426,907 A 1/1984 Scholz
4,681,010 A 7/1987 Wilkinson
4,791,849 A 12/1988 Kelley
4,803,908 A 2/1989 Skinn et al.
4,909,126 A * 3/1990 Skinn et al. ..... 84/454
5,065,660 A 11/1991 de Buda (Continued)

FOREIGN PATENT DOCUMENTS

AT 006 906 U1 5/2004

(Continued)

*Primary Examiner*—Jeffrey Donels
*Assistant Examiner*—Robert W Horn
(74) *Attorney, Agent, or Firm*—Hunton & Williams LLP

(57) ABSTRACT

A device is disclosed for adjusting the tension of the strings of a string instrument, especially a guitar, preferably an electric guitar, or a bass, preferably an electric bass, said strings being secured at a first end to a winding mechanism and at a second end to another mount, said device having at least one motor, a gear connected to the motor and flexible shafts connected to the gear for transmission of a rotational movement generated by the combination of the motor and the gear to the winding mechanism whereby the device has fewer motors than there are strings on the string instrument.

With this device it is possible to arrange a drive for automatic adjustment of the tension of the strings of the string instrument in a space-saving manner and in the smallest possible amount of space.

6 Claims, 4 Drawing Sheets

U.S. PATENT DOCUMENTS

| | | | | | |
|---|---|---|---|---|---|
| 5,265,513 | A | | 11/1993 | Smith | |
| 5,337,664 | A | | 8/1994 | Fishman et al. | |
| 5,343,793 | A | | 9/1994 | Pattie | |
| 5,390,579 | A | | 2/1995 | Burgon | |
| 5,767,429 | A | * | 6/1998 | Milano et al. | 84/454 |
| 5,824,929 | A | * | 10/1998 | Freeland et al. | 84/454 |
| 5,977,467 | A | * | 11/1999 | Freeland et al. | 84/454 |
| 5,986,190 | A | | 11/1999 | Wolff et al. | |
| 6,166,307 | A | * | 12/2000 | Caulkins et al. | 84/50 |
| 6,184,450 | B1 | | 2/2001 | LeBlanc | |
| 6,184,452 | B1 | * | 2/2001 | Long et al. | 84/457 |
| 6,271,456 | B1 | | 8/2001 | Nelson | |
| 6,278,047 | B1 | * | 8/2001 | Cumberland | 84/455 |
| 7,446,249 | B2 | * | 11/2008 | Driscoll | 84/327 |
| 2002/0104428 | A1 | | 8/2002 | Wilson | |
| 2008/0276787 | A1 | * | 11/2008 | Adams | 84/304 |
| 2009/0038462 | A1 | * | 2/2009 | Adams | 84/304 |

FOREIGN PATENT DOCUMENTS

| | | | |
|---|---|---|---|
| DE | 35 09 662 | A1 | 10/1986 |
| FR | 2 365 850 | | 4/1978 |
| GB | 2 226 910 | A | 7/1990 |
| WO | WO 97/04442 | | 2/1997 |
| WO | WO 01/67431 | A1 | 9/2001 |
| WO | WO 03/012774 | A1 | 2/2003 |
| WO | WO 2005/114647 | A1 | 12/2005 |
| WO | WO 2005/116984 | A1 | 12/2005 |
| WO | WO 2005/116985 | A1 | 12/2005 |
| WO | WO 2005/116986 | A1 | 12/2005 |
| WO | WO 2006/076928 | A2 | 7/2006 |

* cited by examiner

DEVICE FOR ADJUSTING THE TENSION OF THE STRINGS OF A STRINGED INSTRUMENT

CROSS-REFERENCE TO RELATED APPLICATION

This application is a national stage of and claims the benefit of priority of International Patent Application No. PCT/EP2005/002851, filed on Mar. 17, 2005, which is relied on and incorporated herein by reference.

BACKGROUND OF THE INVENTION

The present invention relates to a device for adjusting the tension of strings of a string instrument, said strings being attached at a first end to a winding device and at a second end to another mount, the string instrument being in particular a guitar, preferably an electric guitar or a bass, preferably an electric bass.

For correct tuning of string instruments, it is necessary to accurately adjust the tension of the strings stretched between two mounting points on these instruments, so that when a string is struck, a standing wave of the correct frequency develops, thereby creating the desired note.

The strings of a string instrument are usually rigidly attached at one of their two ends, the second end of the string being coiled onto a winding device, e.g., in the form of a spindle or a similar element so that it can be tightened and relaxed by winding and unwinding to thereby achieve the correct tuning of the string.

In particular, when the string instrument is also to be automatically tunable, i.e., by means of a control mechanism that controls a drive to change the string tension on the basis of the actual note picked up from the string that is struck in a comparison of same with an ideal note, so that the string produces the ideal note, the tension of the strings must be adjustable automatically. It has therefore already been proposed elsewhere that each of the winding devices should be provided with its own motor drive.

In the case of a guitar, for example, in particular an electric guitar, and/or a bass, preferably an electric bass, the so-called tuning mechanisms, i.e., the pegs for tightening and relaxing the strings are situated on the so-called head of the instrument and thus on a comparatively small part of the instrument. In principle, motor drives could be mounted here for adjusting the string tensions of the individual strings, but it is very difficult to accommodate all these components on the head of the guitar, where space is very limited, without having a negative effect on its appearance and handling. It is then almost impossible to arrange the entire control for a system for automatic tuning of a guitar and/or a bass, preferably an electric bass, on this part of the instrument in addition to the drives. To this extent, it is desirable to search for alternative options for adjusting the tension of a string of a string instrument.

BRIEF SUMMARY OF THE INVENTION

This object is achieved with a device for adjusting the tension of the strings of a string instrument, in particular a guitar, preferably an electric guitar, or a bass, preferably an electric bass, said strings being secured at a first end to a winding mechanism and at a second end to another mount, having at least one motor, a gear connected to the motor and flexible shafts connected to the gear for transmitting a rotational movement generated by the combination of the motor and the gear to the winding mechanism whereby there are fewer motors in the device than there are strings on a string instrument.

The central inventive idea of the present invention consists of reducing the number of motors on the whole instead of assigning a separate motor to each of the winding mechanisms and transferring the torque generated by the motor via a drive to flexible shafts which are connected to the winding mechanisms to drive them. The use of flexible shafts allows a deflection of the torque in the direction of the winding mechanisms. Essentially it would also be possible to bridge the distance between a torque output of the motor(s) and the winding mechanisms by means of gear wheel combinations, for example, but this would necessitate a complex design involving a number of components. Flexible shafts here have the advantage that they are small, lightweight and are easily arranged in a stringed instrument.

On the example of a guitar in particular, preferably an electric guitar and/or a bass, preferably an electric bass, in which instruments the windings mechanisms in the form of so-called pegs set on the head, the space for providing motors is especially limited. This is where a great deal of space can be saved with the present invention in comparison with equipping each peg with its own motor as proposed elsewhere. This leads first to weight savings at this end of the instrument, which is an extreme advantage, in particular in taring the weight of the instrument. It is troublesome or even impossible for musicians to use "head-heavy" instruments. Furthermore, reducing the number of motors with these instruments means the opportunity to accommodate a controller for automatic tuning of the instrument, for example, in the space that is still available and is not taken up by the motors. If sensors which detect the actual tone of a string that has been struck (e.g., piezoelectric pickups) are also provided on the head of the guitar, in particular an electric guitar, and/or of the bass, preferably electric bass and if there is also a power supply at the head of the instrument, then a device for automatic tuning of the instrument may be arranged entirely on the head there. Such a device functions by detecting the actual tone of a vibrating string of a frequency, comparing this frequency with an ideal frequency stored in the controller and triggering the motor(s) and the gear by means of this controller in such a manner that the winding mechanism assigned to the corresponding string, e.g., the respective peg, is triggered accordingly to tighten or relax the string so that it then oscillate at the specified frequency. As an alternative, such a mechanism may also be distributed in a modular fashion along the instrument for automatic tuning of a string instrument, in particular a guitar or bass, preferably an electric bass. Using the example of a guitar, preferably an electric guitar and/or a bass, preferably an electric bass, the controller may also be arranged on the body of the instrument, in which case it is important to be sure that the control signals from the body to the head are transmitted to the motor(s) and the gear. The controller may equally be provided on the head, but in this case a power supply for the controller and the motor(s) must be carried from the body to the head.

The gear that is provided according to the present invention is preferably designed so that it can individually control a flexible shaft connected to a winding mechanism in a targeted manner and can connect it to the torque output of a motor. This ensures that each of the winding mechanisms can be moved automatically for tightening and relaxing the respective string so that each string can be tightened and relaxed individually and therefore can be tuned individually.

In a preferred embodiment the device has two motors, each generating a torque with opposite directions of rotation. This type of oppositely directed torque may be generated, e.g., by an opposing arrangement of motors rotating in the same direction, in an axial direction based on the torque, but motors running in opposite directions may also be positioned in parallel with one another. Furthermore, in this further embodiment, it is also provided that a gear is used by means of which each of the flexible shafts leading to one winding mechanism can be connected to the torque output of one motor or the other. In this way, by connecting the flexible shaft of one winding device to one motor or the other motor, more precisely to their torque outputs, a movement of the winding mechanism for winding and unwinding the string, i.e., for tightening and/or relaxing same, can be achieved.

In a further embodiment of the device as characterized in that in the normal position of the gear the flexible shafts are shifted to an idling position without any connection to the motor and each flexible shaft of a string which is assigned to a respective winding mechanism is individually connectable via the gear and in a targeted manner to the torque output of at least one motor while the remaining flexible shafts remain in the idling position, wherein the winding mechanisms can be triggered individually for tightening and relaxing the string while the remaining winding mechanisms remain in their momentary positions.

One possible embodiment of the gear which is currently preferred within the scope of the present invention is characterized in that an essentially cylindrical drive roller that rotates about a longitudinal axis and has a friction surface and is connected to at least one motor, and take-up wheels that also have friction surfaces and can be brought into engagement with the drive roller and are connected to the flexible shafts, are arranged in the gear. Such an approach has the advantage in comparison with an approach using gear wheels that the teeth on the respective gear wheels cannot be offset when one of the take-up wheels engages with the drive roller. Rubber surfaces in particular are preferred as the friction surfaces.

Another embodiment of the device is the arrangement of the device on the head of a guitar, preferably an electric guitar or a bass, preferably an electric bass, whereby the flexible shafts are connected to the pegs for rotation of the latter.

BRIEF DESCRIPTION OF THE DRAWINGS

Additional features and advantages of the invention are derived from the following description of one exemplary embodiment on the basis of the accompanying figures. In the figures, the present invention is illustrated on the example of an implementation in an electric guitar. However, the present invention is not limited to this instrument but instead may essentially be used with any string instruments.

The same elements in the figures are labeled with the same reference numerals.

DETAILED DESCRIPTION OF THE INVENTION

Figure 1:
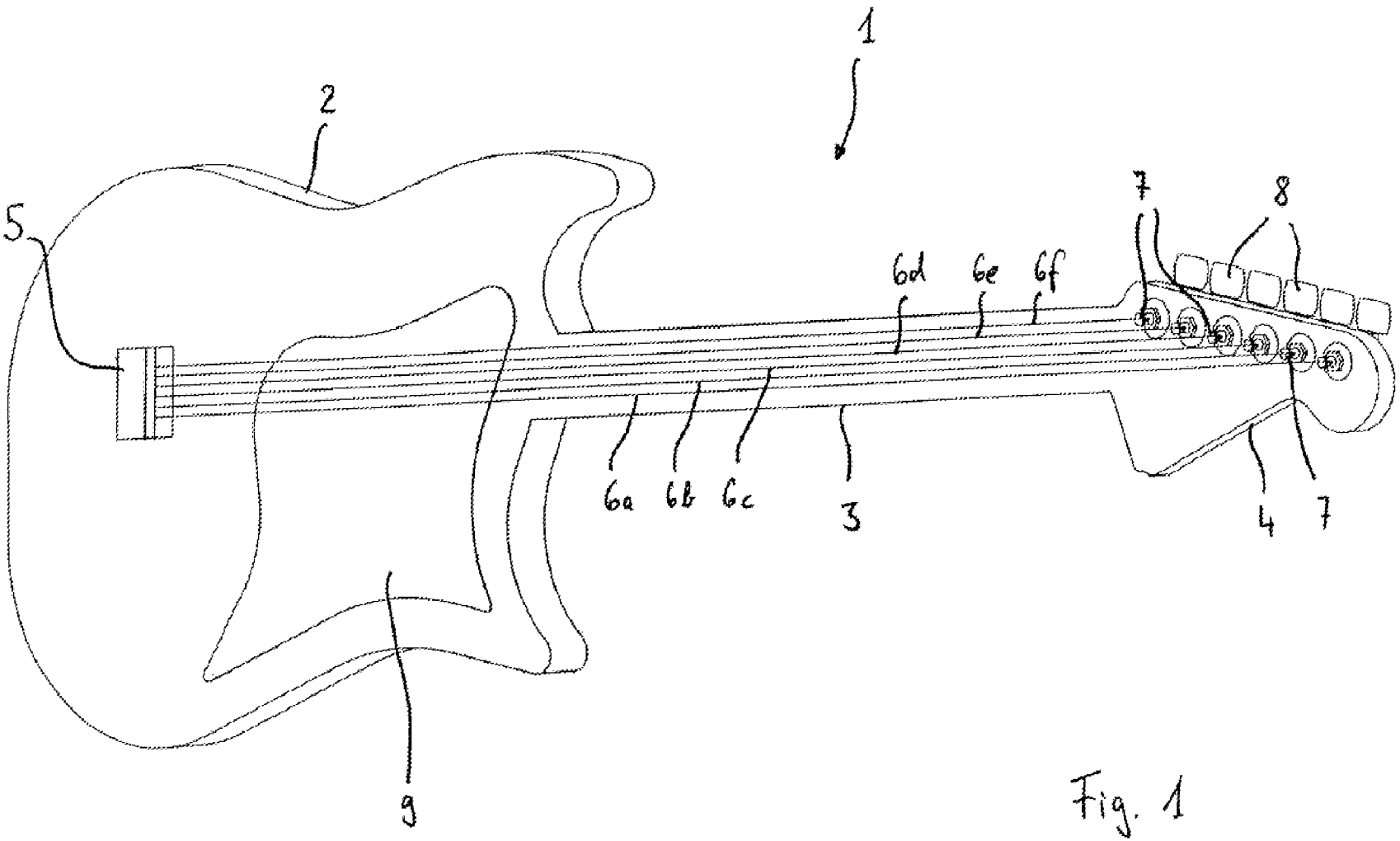
FIG. 1 shows schematically a view of an electric guitar.

In the figures, the invention is illustrated on the basis of an exemplary embodiment mounted on an electric guitar 1 shown in FIG. 1. The invention is not limited to the use of such an electric guitar but may in principle also be used with any string instrument, in particular also in acoustic guitars, electric basses, bowed instruments and the like.

The electric guitar 1 shown schematically in FIG. 1 can be divided roughly into a body 2, a neck 3 and a head 4. A mounting block, in this example a tremolo system block 5 is provided on the body 2 with the guitar strings 6*a* through 6*f* each attached to it at a first end. At their respective second end, the guitar strings 6*a* through 6*f* are wound onto pegs 7 arranged on the head 4. The pegs 7 are connected to thumbscrews 8 which, when turned, cause the pegs 7 to turn and can thus alter the string tension. Finally, there is also a so-called pickguard 9 beneath the string 6*a* through 6*f* on the body 2 of the guitar 1.

The inventive device is arranged in this embodiment on the head 4 of the electric guitar 1 namely on the back side of the head 4, which is opposite the pegs 7.

Figure 2:
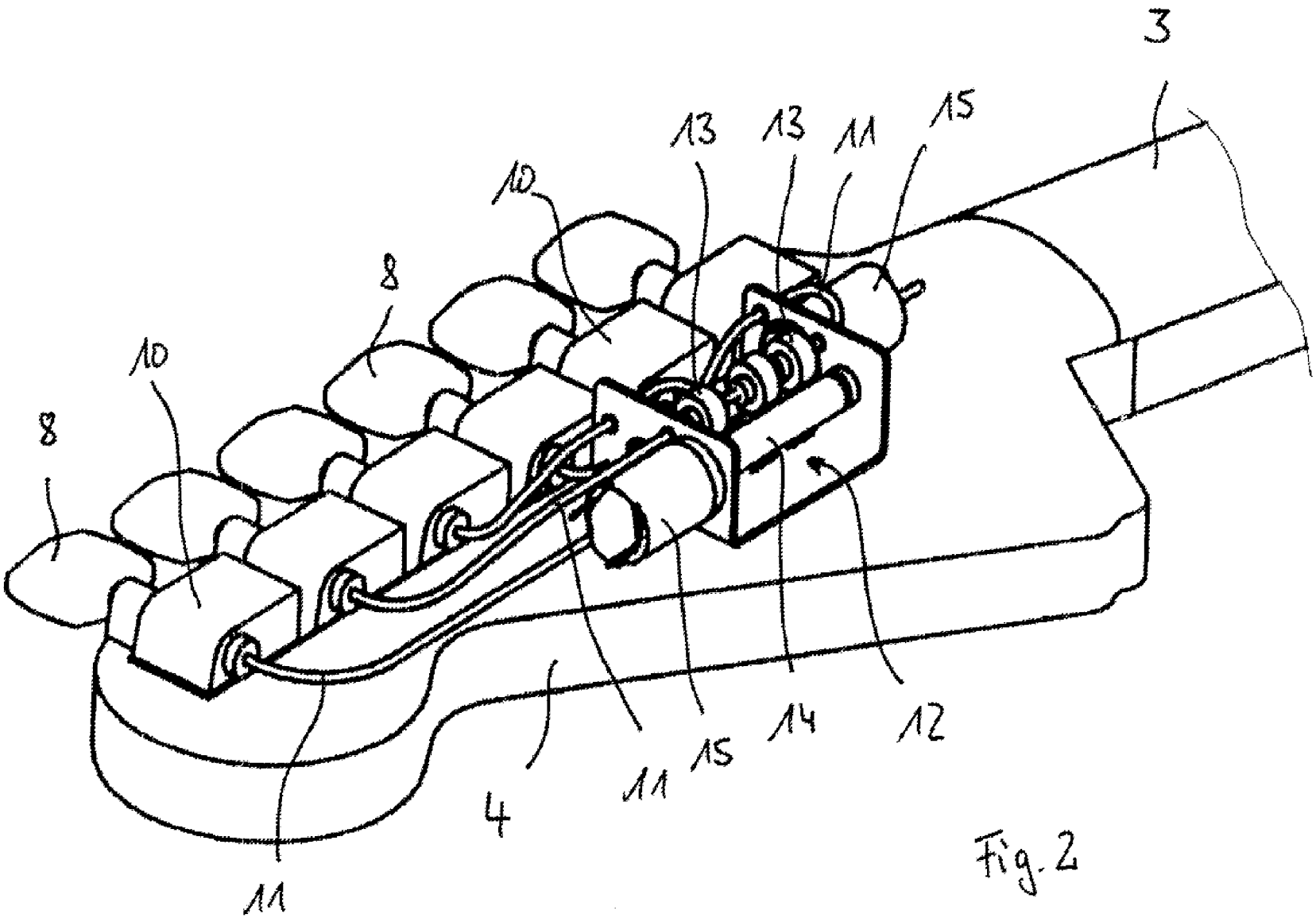
FIG. 2 shows a three-dimensional view of the back of the head of the electric guitar illustrated in FIG. 1 with an inventive device arranged thereon.
Figure 3:
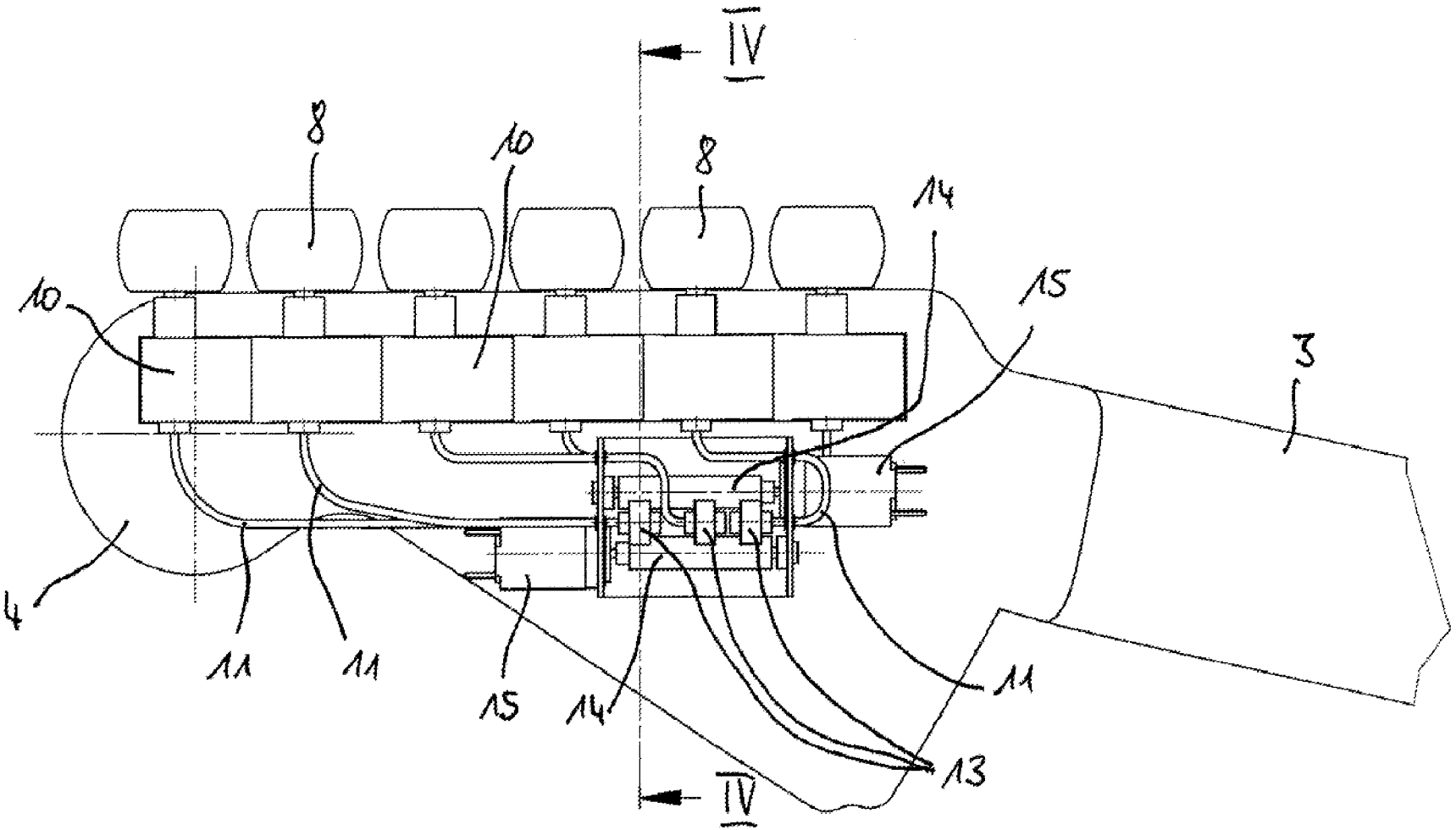
FIG. 3 shows a view of the back of the head of the electric guitar shown in FIG. 2
Figure 4:
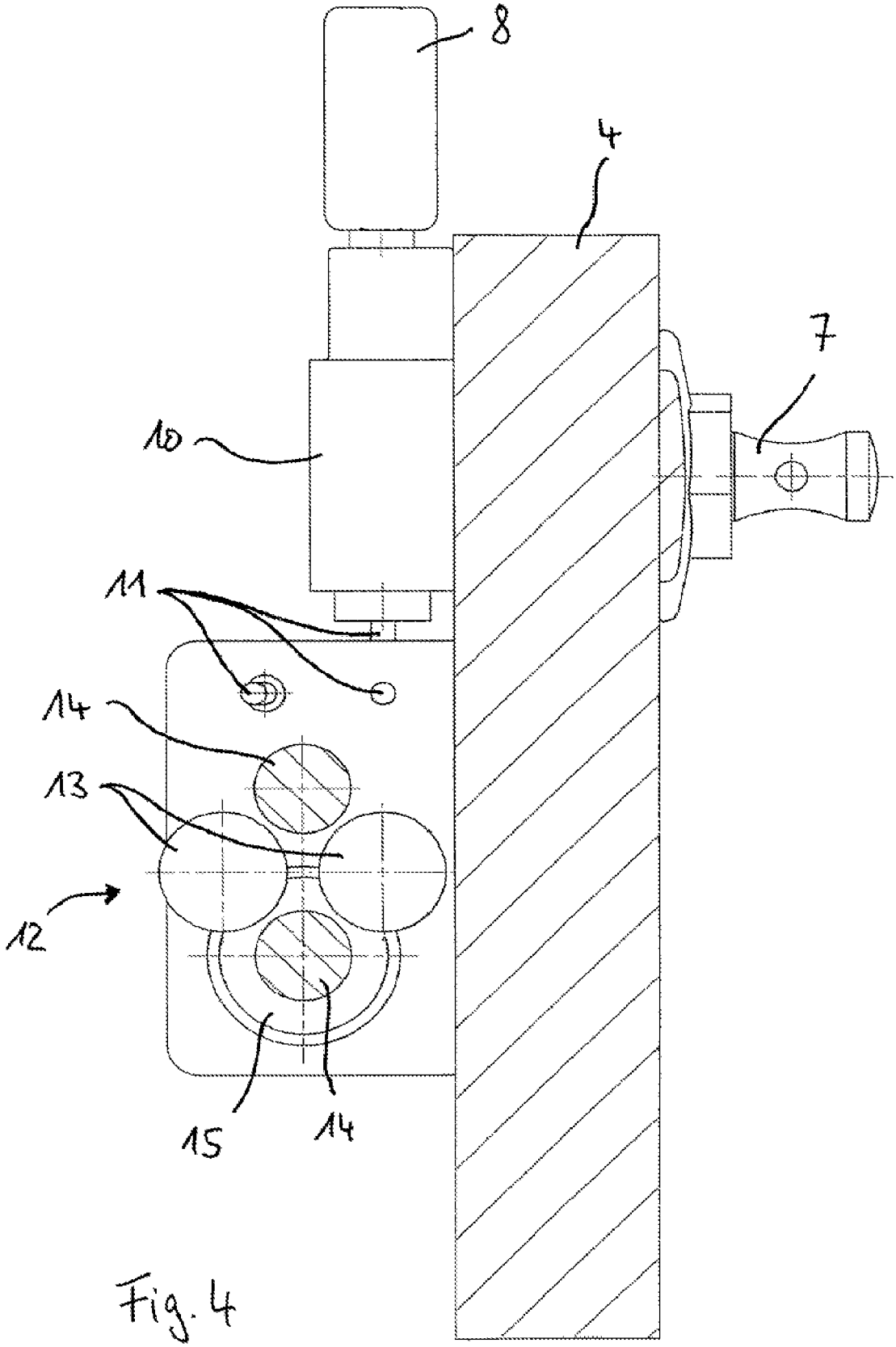
FIG. 4 shows a sectional view through the head of the electric guitar with the inventive device along line IV-IV shown in FIG. 3.

This is illustrated in greater detail in FIGS. 2 through 4. These figures show only the head 4 of the electric guitar 1 and a small section of the neck 3. The pegs 7 for rotating the mechanisms 10 connected to same are arranged on the opposite side. For each peg 7, a flexible shaft 11 is connected to these mechanisms 10. These flexible shafts 11 are each connected to a take-up wheel 13, which is part of a gear 12. Drive rollers 14 are also part of the gear 12. The drive rollers 14 are connected directly to motors 15 arranged opposite one another with respect to the torque in an axial direction. The motors 15 are connected to a power supply (not shown here) so they can cause the drive rollers 14 to rotate.

In a neutral position of the gear 12, the take-up wheels 13 having a radial friction surface are separated from the radial friction surfaces of the drive rollers 14. If one of the pegs 7 is turned to adjust the string tension, the take-up wheel 13 connected to the corresponding flexible shaft 11 is brought in contact at its friction surface with the friction surface of one of the drive rollers 14 in a manner to be described in greater detail below so there can be a transfer of torque from the motor 15 assigned to the drive roller 14 to the peg 7.

As discernible in FIG. 3 in particular, the motors 15 are arranged opposite one another in the axial direction of the drive rollers 14. The motors 15 themselves both have a torque output in the same direction but a torque with the opposite direction is output to the drive rollers 14 due to the opposing arrangement. Therefore, the take-up wheels 13 may be rotated in a first direction of rotation by engagement with one of the drive rollers 14 or in an opposite direction of rotation to the first direction of rotation. In other words, depending on the drive roller 14 selected with which a certain take-up wheel 13 is engaged, the respective flexible shaft 11 and thus ultimately the peg 7 are driven in the particular direction of rotation required to relax or tighten the string.

FIG. 4 shows again clearly that in an idling position the take-up wheels 13 with their friction surfaces are separated from the friction surfaces of the drive rollers 14. Only when a selected peg 7 is to be turned in a certain direction is the respective take-up wheel 13 with its radial friction surface pressed in a targeted manner against the radial friction surface of the corresponding drive roller 14 to achieve an adjustment of the peg 7 and thus tightening or relaxing of the string wound onto this peg 7.

FIG. 4 also shows that for a space-saving design, a total of six take-up wheels (one for each of six pegs 7) are arranged one above the other in two planes in the view shown in FIG. 3. In the same way, the flexible shafts 11 are also guided in two planes.

The device illustrated here is very suitable in particular for being tied into a system for automatic tuning of the string instrument, namely the electric guitar 1 here. The motors 15 as well as the gear 12 and/or a trigger mechanism are therefore connected to a controller for coupling of individual take-up wheels 13. This controller is also connected to a detection unit for detecting the actual frequency in which a string vibrates and the controller is capable of comparing this actual frequency with an ideal frequency. On the basis of the results of this comparison, the controller controls one of the motors 15 (depending on the direction of rotation required for tightening or relaxing the string to be tuned). Furthermore, the controller triggers a coupling mechanism which causes the take-up wheel 13 that is assigned to the peg 7 and on which the string to be tightened is wound to engage with the drive roller 14 assigned to the triggered motor 15 so that the string is either tightened or relaxed. The controller also controls when the string has the right tension, preferably by feedback regulation in which the sound generated by the string is permanently monitored, and then releases the take-up wheel 13 from the drive roller 14 and turns off the motor 15.

Mechanisms for connecting a take-up wheel 13 to one of the drive rollers 14 may be driven pneumatically or magnetically, preferably electromagnetically.

The exemplary embodiment described and illustrated here is not restrictive but instead serves merely to illustrate the present invention. The present invention is limited in its full extent exclusively by the following claims.

LIST OF REFERENCE NUMERALS

1 electric guitar
2 body
3 neck
4 head
5 tremolo system block
6*a-f* string
7 peg
8 thumbscrew
9 pickguard
10 mechanism
11 flexible shaft
12 gear
13 take-up wheel
14 drive roller
15 motor

The invention claimed is:

1. A device for adjusting the tension of strings of a string instrument comprising a string secured at a first end to a winding mechanism and at a second end to another mount, at least one motor, a gear connected to the motor and flexible shafts connected to the gear for transmitting a rotational movement generated by the combination of the motor and the gear to the winding mechanism, wherein there are fewer motors than strings of the string instrument and wherein the device is integrated in a string instrument selected from the group consisting of a guitar and bowed instrument.

2. A device for adjusting the tension of strings of a string instrument comprising a string secured at a first end to a winding mechanism and at a second end to another mount, at least two motors, each generating a torque with opposing directions of rotation, at least one gear connected to the at least two motors and flexible shafts connected to the at least one gear for transmitting a rotational movement generated by the combination of a motor and the at least one gear to the winding mechanism, and a gear enabling a flexible shaft of the flexible shafts guided to one winding mechanism to be connected to the torque output of one motor or the other, wherein there are fewer motors than strings of the string instrument.

3. The device according to claim 1, wherein in a first position of the gear the flexible shafts are shifted to an idling position without any connection to the motor and each flexible shaft of a string which is assigned to a respective winding mechanism is individually connectable via the gear and to the torque output of at least one motor while the remaining flexible shafts remain in the idling position.

4. A device for adjusting the tension of strings of a string instrument comprising a string secured at a first end to a winding mechanism and at a second end to another mount, at least one motor, a gear connected to the at least one motor and flexible shafts connected to the gear for transmitting a rotational movement generated by the combination of the at least one motor and the gear to the winding mechanism, wherein there are fewer motors than strings of the string instrument and wherein the gear includes a drive roller that can rotate about a longitudinal axis and has a friction surface and is assigned to at least one motor and take-up wheels having friction surfaces that are connected to the flexible shafts and can be brought into engagement with the drive roller.

5. The device according to claim 4, wherein the drive roller and the take-up wheels have friction surfaces made of rubber.

6. The device according to claim 1, wherein said device is arranged on the head of a guitar, and the flexible shafts are connected to pegs for rotation of the pegs.

* * * * *